US008216012B1

(12) United States Patent
Bona et al.

(10) Patent No.: US 8,216,012 B1
(45) Date of Patent: Jul. 10, 2012

(54) AUTOMATIC MOORING LINE BRAKE

(75) Inventors: Samuel R. Bona, La Mesa, CA (US); Timothy J. Keenan, San Diego, CA (US); Joshua D. Bianchi, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 85 days.

(21) Appl. No.: 12/637,453

(22) Filed: Dec. 14, 2009

(51) Int. Cl.
*B63B 22/18* (2006.01)

(52) U.S. Cl. ..... 441/25

(58) Field of Classification Search ..... 102/413, 102/414; 441/21–33; 114/293, 230.2–230.4
See application file for complete search history.

(56) References Cited

U.S. PATENT DOCUMENTS

| | | | | |
|---|---|---|---|---|
| 3,444,508 | A | 5/1969 | Granfors et al. | |
| 3,986,159 | A | 10/1976 | Horn | |
| 3,990,255 | A | 11/1976 | Cosier et al. | |
| 4,044,863 | A | 8/1977 | Feldman | |
| 4,055,121 | A * | 10/1977 | Jasperson et al. | 102/414 |
| 4,301,734 | A * | 11/1981 | Peregrim et al. | 102/413 |
| 5,020,032 | A | 5/1991 | Dale et al. | |
| 5,341,718 | A | 8/1994 | Woodall, Jr. et al. | |
| 5,973,994 | A | 10/1999 | Woodall | |
| 7,179,145 | B2 | 2/2007 | Driscoll et al. | |

* cited by examiner

*Primary Examiner* — Edwin Swinehart
(74) *Attorney, Agent, or Firm* — Peter A. Lipovsky; Kyle Eppele

(57) ABSTRACT

Deployment of a moored undersea device is achieved by fixing a mooring line to an anchor, and allowing the mooring line to unwind from a winding reel. A winding reel control mechanism is responsive to underwater hydrostatic pressure to release the mooring line when the hydrostatic pressure exceeds a predetermined level. When the hydrostatic pressure falls below the predetermined level, the winding reel control mechanism prevents further pay out of the mooring line.

9 Claims, 3 Drawing Sheets

AUTOMATIC MOORING LINE BRAKE

BACKGROUND

This disclosure describes a device and technique to automatically moor an object, which has been released from the bottom of the ocean, at a predetermined distance below the surface of the water.

SUMMARY

Apparatus for deployment of a moored undersea device includes an anchor, a mooring line attached to the anchor and a winding reel. The winding reel is provided with a mooring line engagement mechanism which controls unwinding of the mooring line. The mooring line engagement mechanism responds to underwater hydrostatic pressure to engage the mooring line when hydrostatic pressure falls below a predetermined level. A buoyancy mechanism is used and is capable of buoying an assembly which comprises the winding reel.

DETAILED DESCRIPTION

Overview

In certain mooring applications, it is desired to anchor a mooring device and cause the mooring device to extend to a certain moored height. The moored height is thus a predetermined depth below the surface of the water. The moored height is a predetermined depth which is established from the surface (hence "depth"), as opposed to defining the moored height as a measurement from the anchor point. Consequently, the length of the mooring line is a function of the predetermined depth, the distance from the predetermined depth to the sea bottom anchor point and the current.

Previous methods to moor objects included a line of predetermined length and other electronic braking devices; however, a mooring line of predetermined length only works to achieve the predetermined depth if the exact water depth and the exact current are known beforehand. The determination of water depth requires that a precise determination of the anchor point be made. The determination of current requires a determination of water depth and the strength of the currents at different depths. It is also necessary to integrate the effects of current along the mooring line, thereby factoring in the force of current on the moored object. It would be desirable to be able to moor objects at a predetermined depth without the need for a precise calculation of depth to the anchor point and/or without a need to precisely integrate current along the mooring line, factored in with the force of current on the moored object.

Electronic mooring line braking devices are relatively complex, require electrical power to operate, and require larger forces to pay out the mooring line.

The disclosed technique allows objects to be moored at desired depths without a need to pre-calculate the current or water depth.

The disclosed apparatus comprises a spool on which is wound a mooring line, a spring, an o-ring, a pin and a cone. This device has a pin sealed by using an o-ring that has atmospheric pressure on one side and hydrostatic pressure on the other. The spring is locked on the atmosphere side resisting the hydrostatic pressure. At depth, the hydrostatic pressure overcomes the spring force and pushes the pin in. As the device ascends in the water column, the decreasing hydrostatic pressure allows the spring force to overcome the depth pressure activating the pin, which in turn catches or trips the mooring line. The pin thereby blocks movement of the mooring line from unwinding about the spool, which prevents further payout from the spool. By varying spring properties, pin dimension, o-rings and o-ring grooves, the depth at which the brake activates can be tuned for the specific brake application.

This design provides for a simple operation requiring no external power or electronics to activate the brake. Because of this simplicity, this design has advantages of smaller size and lower mooring line pay out tensions.

Spooled Mooring Line with Payout Cone and Locking Pin

Figure 1:
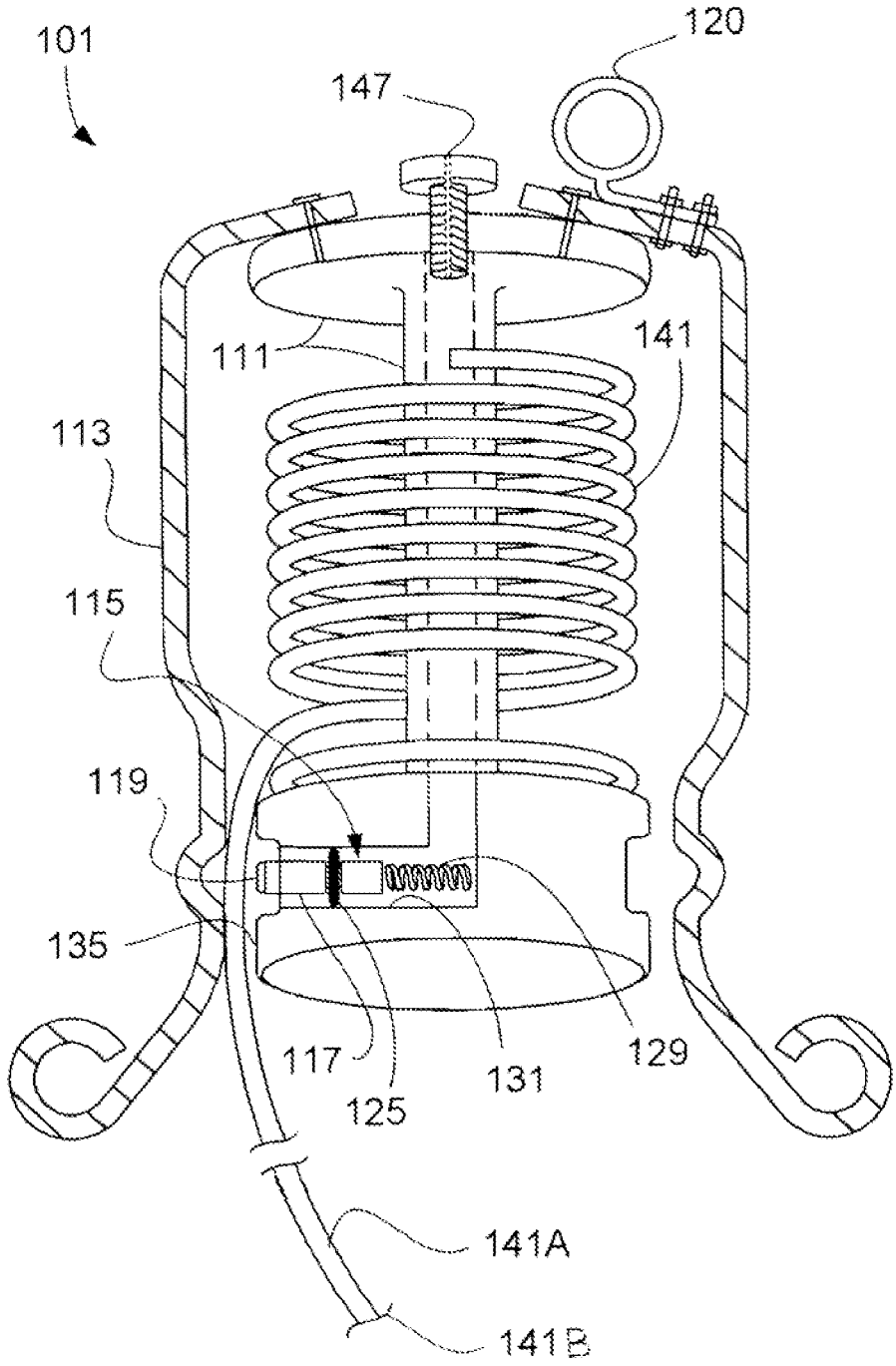
FIG. 1 is a diagram showing an example configuration of a mooring line brake.

FIG. 1 is a diagram showing an example configuration of a mooring line brake 101. Depicted are mooring line spool 111, mooring line payout cone 113 and locking pin 115. Locking pin 115 includes piston 117 and engagement extension 119. The components are either buoyant or external buoyancy may be attached. In the case of external buoyancy, the external buoyancy is added by attachment to a fitment, as represented by attachment ring 120, and therefore the fitment becomes a means for providing the external buoyancy.

O-ring 125 forms a seal for piston 117 and spring 129 acts against piston 117. Piston 117 and spring 129 are received in chamber 131 within spool 111. Chamber 131 extends from a payout flange 135 of spool 111 and extends radially toward the center of spool 111. Chamber 131 is set at a predetermined gas pressure, such as atmospheric pressure. Piston 117 has an exterior side which forms engagement extension 119. The exterior side or engagement extension 119 is exposed to ambient pressure which is atmospheric pressure during non-deployment storage, but which is hydrostatic pressure when deployed in a sea environment. The action of piston 117 in chamber 131 is similar to that of a pressure regulator valve, in that piston 117 responds to a combination of the balance of pressures and the biasing of spring 129. The sea's hydrostatic pressure urges piston 117 inward against the atmospheric pressure in the chamber; however piston 117 must also overcome the force of spring 129, so that piston 117 remains in a position toward an outer perimeter of payout flange 135 until the hydrostatic pressure is sufficient to overcome the force of spring 129.

Piston 117, chamber 131 and spring 129 are sized to cause engagement extension 119 to extend beyond the spool's outer perimeter at payout flange 135 when the sea's hydrostatic pressure is not sufficient to force piston 117 inward. Spring 129 is chosen to set the hydrostatic pressure at which piston 117 retracts. This hydrostatic pressure determines the predetermined depth at which mooring line brake 101 actuates to prevent further line payout.

Mooring line payout cone 113 fits over mooring line spool 111 and acts as a feed guide. Mooring line 141 is wound around spool 111 and has a free end 141A extending outward from mooring line spool 111 past payout flange 135. Free end 141A could be attached to a sea bottom positioned anchor 141B, for example. With locking pin 115 retracted into spool 111, the mooring line 141 is free to unwind from spool 111. When the mooring line 141 pays out, free end 141A must wind about payout flange 135 and pass locking pin 115 on each winding rotation. As a result, when piston 117 extends outward to allow extension 119 to extend beyond the outer diametrical perimeter of payout flange 135, extension 119 will engage payout cone 113, thereby blocking and arresting the free end 141A of the mooring line 141 from further payout. Since this condition occurs at and above the predetermined depth and does not exist below the predetermined depth, mooring line 141 is free to unwind below the predetermined depth, but piston 117 and extension 119 restrain such unwinding above the predetermined depth.

Mooring line 141 is allowed to payout by rotation with respect to payout cone 113 to the point of reaching the predetermined depth, and will take into account the effect of sea currents on mooring line 141. This would work in a static situation, meaning fixed depth of anchorage and fixed currents. Tidal variations can change depth, and it is possible that changes in the depth of the mooring line brake 101 will occur in response to daily tides. Sea currents also change as a result of tides, weather conditions or from transient events such as movement of a ship past the mooring. These changes could periodically cause the mooring line brake 101 to sink below the predetermined depth. If, during such transient events, the mooring line brake101 payed out additional mooring line 141, then the mooring line brake 101 would rise above the predetermined level over time.

To prevent the mooring line brake 101 from paying out more line during transient events, it is possible to include a bleed valve 147 placed in communication with chamber 131. Bleed valve 147 may optionally be plugged with a sea water soluable material (not separately shown) to delay the bleed function. Bleed valve 147 permits water at hydrostatic pressure to slowly leak into chamber 131, gradually allowing the pressure inside chamber 131 to rise to that of hydrostatic pressure at the predetermined depth. As a result, transient changes in depth resulting from tidal variations and current variations will no longer be sufficient to cause piston 117 to retract inward by overcoming spring pressure (spring 129). Consequently, mooring brake 101 can retain the mooring line 141 at a fixed length.

Example

Spooled Mooring Line with Flap Catch

Figure 2:
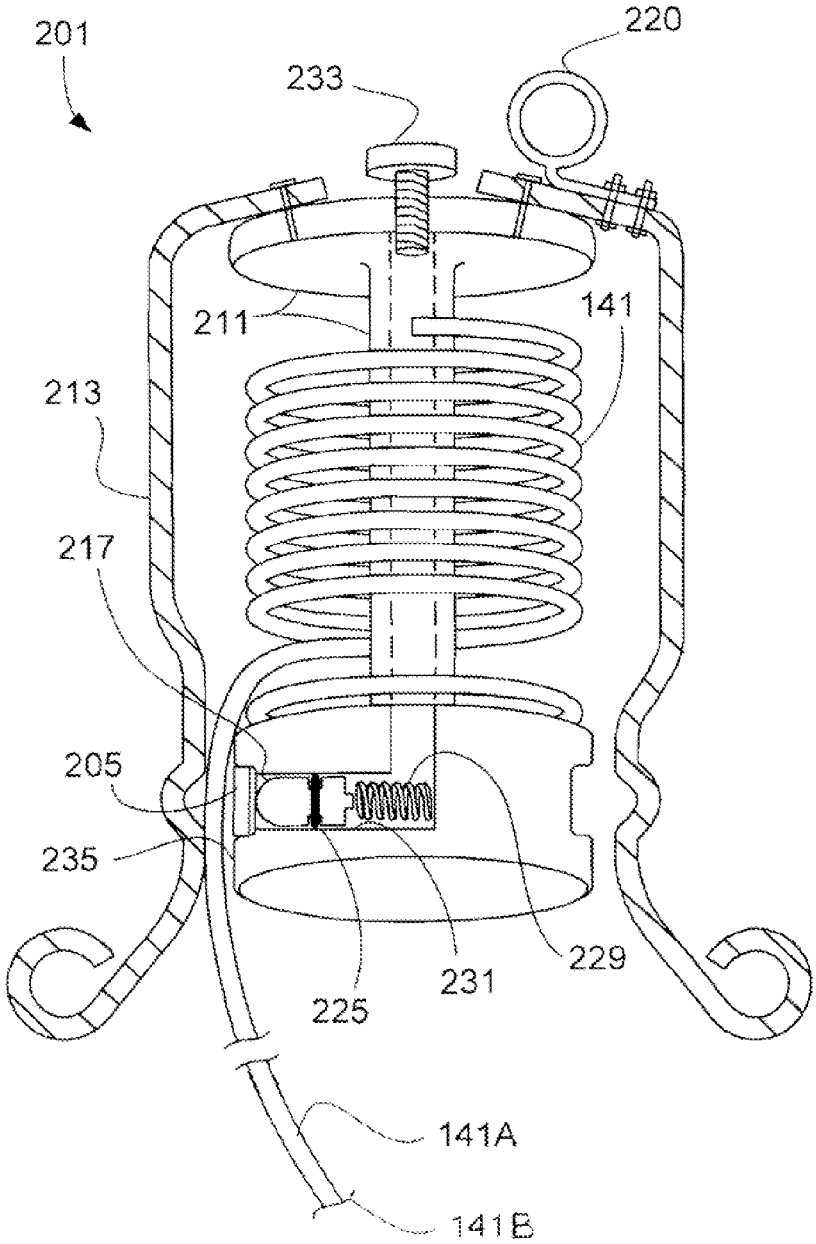
FIG. 2 is a diagram showing an example of a different configuration of a mooring line brake.
Figure 3:
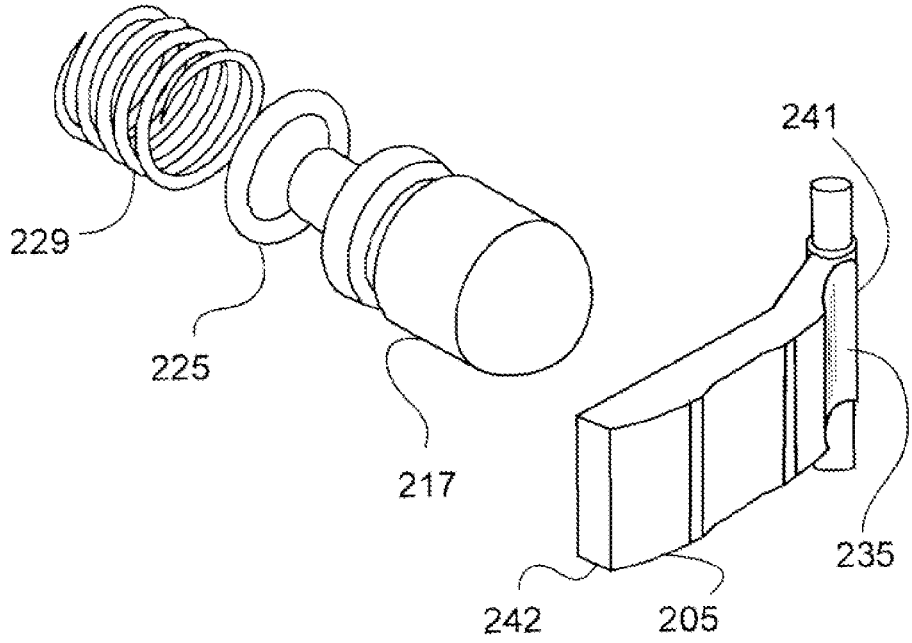
FIG. 3 is a diagram showing details of a latch mechanism as may be used in the configuration of FIG. 2.

FIG. 2 is a diagram showing an example of a different configuration, mooring line brake 201, in which a catch flap 205 functions as a latch piece to arrest line movement. As is the case of the configuration of FIG. 1, the arrangement similarly uses a line spool 211 and a mooring line payout cone 213. A locking piston 217 is provided, but is used to engage catch flap 205, details of which are depicted in FIG. 3. As is the case with the configuration of FIG. 1, the components of the configuration of FIGS. 2 and 3 are either buoyant or an external buoyancy mechanism is attached, as may be effectuated via attachment ring 220.

O-ring 225 forms a seal for piston 217 and spring 229 acts against piston 217. Piston 217 and spring 229 are received in chamber 231 within spool 211. Chamber 231 is otherwise sealed, as represented by plug 233. Chamber 231 extends from a pay out flange 235 of spool 211 and extends radially with respect to spool 211. Chamber 231 is set at a predetermined gas pressure, such as atmospheric pressure. The exterior side of piston 217 is exposed to ambient pressure which is also atmospheric pressure during non-deployment storage, but which is hydrostatic pressure when deployed in a sea environment. The action of piston 217 in chamber 231 is similar to that of a pressure regulator valve, in that piston 217 responds to a combination of the balance of pressures and the biasing of spring 229. The sea's hydrostatic pressure urges piston 217 inward against the atmospheric pressure in the chamber; however the hydrostatic pressure against piston 217 must also overcome the force of spring 229, so that piston 217 remains in a position toward an outer diametrical perimeter of payout flange 235 until hydrostatic pressure is sufficient to overcome the force of spring 229.

Piston 217, chamber 231 and spring 229 are sized to cause locking piston 217 to extend beyond the spool's outer perimeter at payout flange 235 when the hydrostatic pressure is not sufficient to force piston 217 inward. Spring 229 is chosen to set the hydrostatic pressure at which piston 217 retracts. This hydrostatic pressure determines the predetermined depth at which the mooring line brake 201 actuates to prevent and arrest further line payout.

Mooring line payout cone 213 fits over mooring line spool 211. As is the case with the configuration of FIG. 1, mooring line 141 is wound around spool 211 and has a free end 141A extending outward from mooring line spool 211 past pay out flange 235 and to anchor 141B. With locking piston 217 refracted into spool 211, the mooring line 141 is free to unwind from spool 211. When the mooring line 141 pays out, free end 141A must wind about pay out flange 235 and pass locking piston 217 on each winding rotation. As a result, when piston 217 extends outward to allow locking piston 217 to extend beyond the diametrical outer perimeter of payout flange 235, locking piston 217 will engage catch flap 205, which acts as a latch piece. Catch flap 205, in turn, arrests the mooring line 141, which prevents further payout of the mooring line 141. Piston 217 therefore engages catch flap 205 so as to open catch flap 205.

With the mooring line 141 is engaged by catch flap 205, catch flap 205 is prevented from retracting. Thus, when the depth of mooring line brake 201 increases, mooring line 141 remains engaged by catch flap 205. When the depth of mooring line decreases, locking piston 217 again engages catch flap 205 and mooring line remains engaged by catch flap under this condition as well. During engagement by the latch piece of the mooring line, the mooring line retains the catch flap 205 in the engagement position. The retention of the mooring line by the catch flap 205 prevents disengagement of the mooring line until release of tension of the mooring line.

FIG. 3 shows details of catch flap 205. Catch flap 205 is hinged in substantial parallel alignment to the free end 141A of the mooring line 141. If mooring line 141 is wound around spool 211 to unwind past catch flap 205 from hinge end 241 toward free end 242, then mooring line 141 will be seized by groove 235. If mooring line 141 is wound so that unwinding causes the free end 141A to pass catch flap 205 from hinge end 241 to the free end 242, then mooring line 141 can force piston 217 inward, given enough force between attachment ring 220 and free end 141A.

As depicted in FIG. 3, catch flap 205 is formed with a groove 235 designed to conform to part of the exterior of mooring line 141. Groove 235 catches mooring line 141 and reduces the ability of the mooring line to apply pressure to the piston mechanism by reducing the rotational vector of force applied by the free end of the mooring line 141A to catch flap 205. As a result, during engagement by the latch piece of the mooring line, the mooring line at least partially engages a portion of the latch piece by catching on groove 235. This prevents the mooring line from resetting the mooring line brake 201 until the force applied by mooring line 141 establishes a rotational vector about the hinge sufficient to close catch flap 205 against piston 217 and spring 229. Groove 235 is configured so that, during engagement by the catch flap 205 of mooring line 141, the catch flap 205 reduces or eliminates force applied to the disengage piston 217 and spring 229. This reduces a tendency of catch flap 205 to disengage mooring line 141 and, in turn, accommodates tidal variations and other changes in depth after deployment of the mooring line brake 201.

It is possible to configure groove 235 so that force applied by mooring line 141 to groove 235 acts to prevent catch flap 205 from releasing mooring line 141.

It is alternatively possible to wind mooring line 141 so that free end 141A passes catch flap 205 from free end 242 to hinge end 241. This permits mooring line 141 to snag catch flap 205 to the locked position. In that circumstance, once mooring line 141 is blocked by catch flap 205, it becomes difficult to free mooring line 141 to extend further.

Variations

The above descriptions are of configurations which demonstrate example implementations of the disclosed concepts. It is possible to implement the latch mechanism by the use of different pin shapes to help catch the mooring line, different size springs, different o-ring and different pins. Additionally, the brake can operate on different components, such as, for example, preventing rotation of a rotating spool.

It is also possible to provide the piston or catch flap on the outer cone or cover, so that the piston or catch flap engages toward the spool. This would further allow the piston or catch flap to block the mooring line by extending past a flange portion of the spool.

Conclusion

It will be understood that many additional changes in the details, materials, steps and arrangement of parts, which have been herein described and illustrated to explain the nature of the invention, may be made by those skilled in the art within the scope of the invention as expressed in the appended claims.

What is claimed is:

1. A mooring line brake apparatus, the apparatus comprising:

an anchor;

a mooring line attached to the anchor;

a mooring line winding reel, a portion of the mooring line being wound about said mooring line winding reel;

a mooring line engagement mechanism, responsive to pressure to prevent unwinding of the mooring line when the pressure falls below a predetermined level; and a buoyancy mechanism, capable of buoying an assembly comprising the winding reel.

2. The apparatus of claim 1, in which the pressure-responsive mooring line engagement mechanism is responsive to hydrostatic pressure so that hydrostatic pressure exceeding the predetermined level results in the release of the mooring line.

3. The apparatus of claim 1, wherein the mooring line winding reel comprises a piston assembly, a release side of the piston exposed to hydrostatic pressure, and an engagement side of the piston exposed to air pressure within an air chamber.

4. The apparatus of claim 3, wherein the mooring line winding reel further comprises a bleed circuit in communication with the air chamber, the bleed circuit resulting in the air chamber pressure increasing sufficiently to overcome variations in pressure without releasing the mooring line in response to variations in pressure.

5. The apparatus of claim 4, wherein the piston assembly extends from one of the winding reel and a mooring line feed guide, so as to control payout of the mooring line by controlling unwinding of the mooring line about the winding reel.

6. The apparatus of claim 3, further comprising:

a bleed circuit in communication with the air chamber, the bleed circuit allowing increased pressure in the chamber; and a biasing device biasing the piston assembly to a latched position, so that the combination of the biasing and increased pressure in the chamber prevents the piston assembly from releasing in response to variations in hydrostatic pressure subsequent to an initial time after deployment.

7. The apparatus of claim 3, further comprising:

a latch piece engaged by the piston, whereby movement of the piston causes the latch piece to move into or away from a position wherein the latch piece engages the mooring line; and the latch piece configured so that, during engagement by the latch piece of the mooring line, the latch piece reduces or eliminates force applied to the piston by the mooring line.

8. The apparatus of claim 1, further comprising a delayed pressure response change device causing the release mechanism to remain in a latched condition during variations in hydrostatic pressure at least within a predetermined range after a time delay established by the delayed pressure response change device.

9. The apparatus of claim 8, wherein the delayed pressure response change device comprises a bleed circuit.

* * * * *